US007753664B2

(12) United States Patent
Go

(10) Patent No.: US 7,753,664 B2
(45) Date of Patent: Jul. 13, 2010

(54) ROTARY PUMP

(75) Inventor: Jin-Gieong Go, Gwacheon (KR)

(73) Assignee: Himtool Co., Ltd., Seoul (KR)

( * ) Notice: Subject to any disclaimer, the term of this patent is extended or adjusted under 35 U.S.C. 154(b) by 395 days.

(21) Appl. No.: 11/721,395

(22) PCT Filed: Dec. 8, 2005

(86) PCT No.: PCT/KR2005/004205

§ 371 (c)(1),
(2), (4) Date: Jun. 11, 2007

(87) PCT Pub. No.: WO2006/062367

PCT Pub. Date: Jun. 15, 2006

(65) Prior Publication Data

US 2009/0238708 A1 Sep. 24, 2009

(30) Foreign Application Priority Data

Dec. 11, 2004 (KR) ..... 10-2004-0104533

(51) Int. Cl.
*F03C 4/00* (2006.01)
*F04B 1/10* (2006.01)
*F04B 1/113* (2006.01)

(52) U.S. Cl. ..... 418/68; 418/64; 418/161; 418/164; 123/44 D; 417/462

(58) Field of Classification Search ..... 418/68, 418/64, 161, 164; 123/44 D; 417/462
See application file for complete search history.

(56) References Cited

U.S. PATENT DOCUMENTS 753,390 A * 3/1904 Hamann ..... 417/462
1,383,997 A * 7/1921 Pease ..... 417/462

(Continued)

FOREIGN PATENT DOCUMENTS

EP 00623749 A 3/1998

(Continued)

OTHER PUBLICATIONS

Patent Abstract of Japan, JP 10-281052 A, published Oct. 20, 1998.

(Continued)

*Primary Examiner*—Thomas E Denion
*Assistant Examiner*—Mary A Davis
(74) *Attorney, Agent, or Firm*—Locke Lord Bissell & Liddell LLP

(57) ABSTRACT

Disclosed herein is a rotary pump in which one or more rotors including rotary cylinders and rotary pistons rotate upon inside a housing having a suction hole and a discharge hole to compress a pump fluid. More particularly, the two rotary pistons are arrange to revolve about a rotating shaft in a state wherein the center of mass of the two rotary pistons coincide with that of the rotating shaft, thereby achieving not only a reduction in the generation of vibrations or noise, but also a variation in the flow of rate of fluid. The rotary pump may have a cover, which is opened or closed in accordance with a pressure, to prevent the generation of backflow and pulsations in accordance with the rotation of the rotary pump when the pressure of the discharge hole differs from that of the suction hole.

1 Claim, 5 Drawing Sheets

U.S. PATENT DOCUMENTS

| | | | | | |
|---|---|---|---|---|---|
| 1,853,394 | A | * | 4/1932 | Appel | 417/462 |
| 1,887,884 | A | * | 11/1932 | Eyston | 418/161 |
| 6,206,661 | B1 | * | 3/2001 | Iida et al. | 417/462 |

FOREIGN PATENT DOCUMENTS

| | | | | |
|---|---|---|---|---|
| JP | 06272671 | A | * | 9/1994 |
| JP | 10-281052 | A | | 10/1998 |
| JP | 10-281052 | A | | 10/1998 |
| JP | 11-013647 | A | | 1/1999 |
| JP | 11-324899 | A | | 11/1999 |
| KR | 99-0073188 | A | | 10/1999 |

OTHER PUBLICATIONS

Patent Abstract of Japan, JP 11-013647 A, published Jan. 19, 1999.
Patent Abstract of Japan, JP 11-324899 A, published Nov. 26, 1999.
International Search Report for PCT/KR2005/004205, dated Feb. 28, 2006.

* cited by examiner

[Fig. 1] (Prior Art)
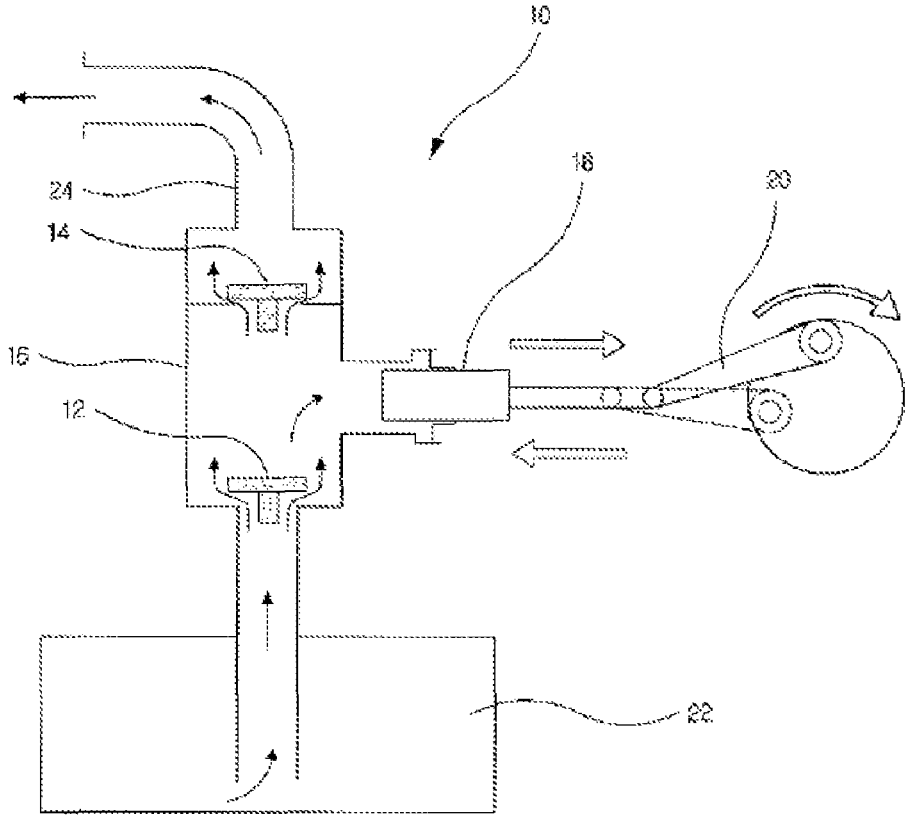
[Fig. 2] (Prior Art)
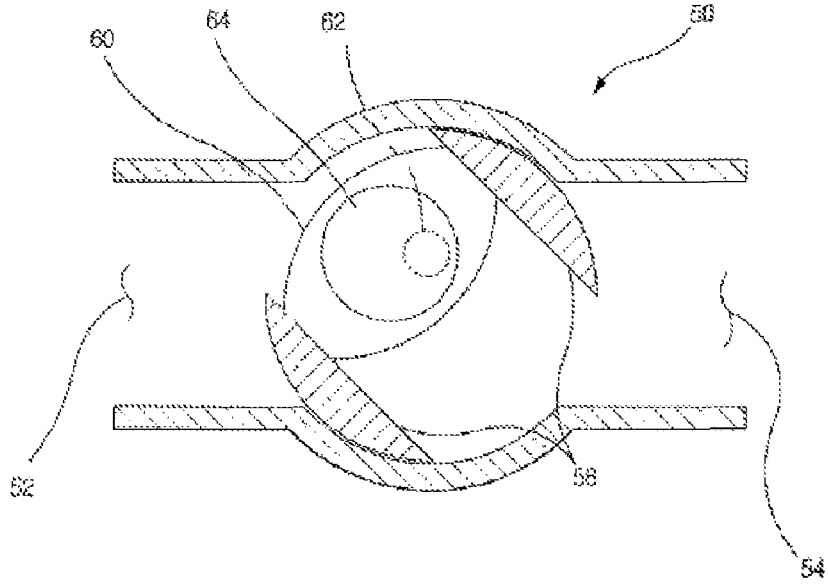

[Fig. 3]
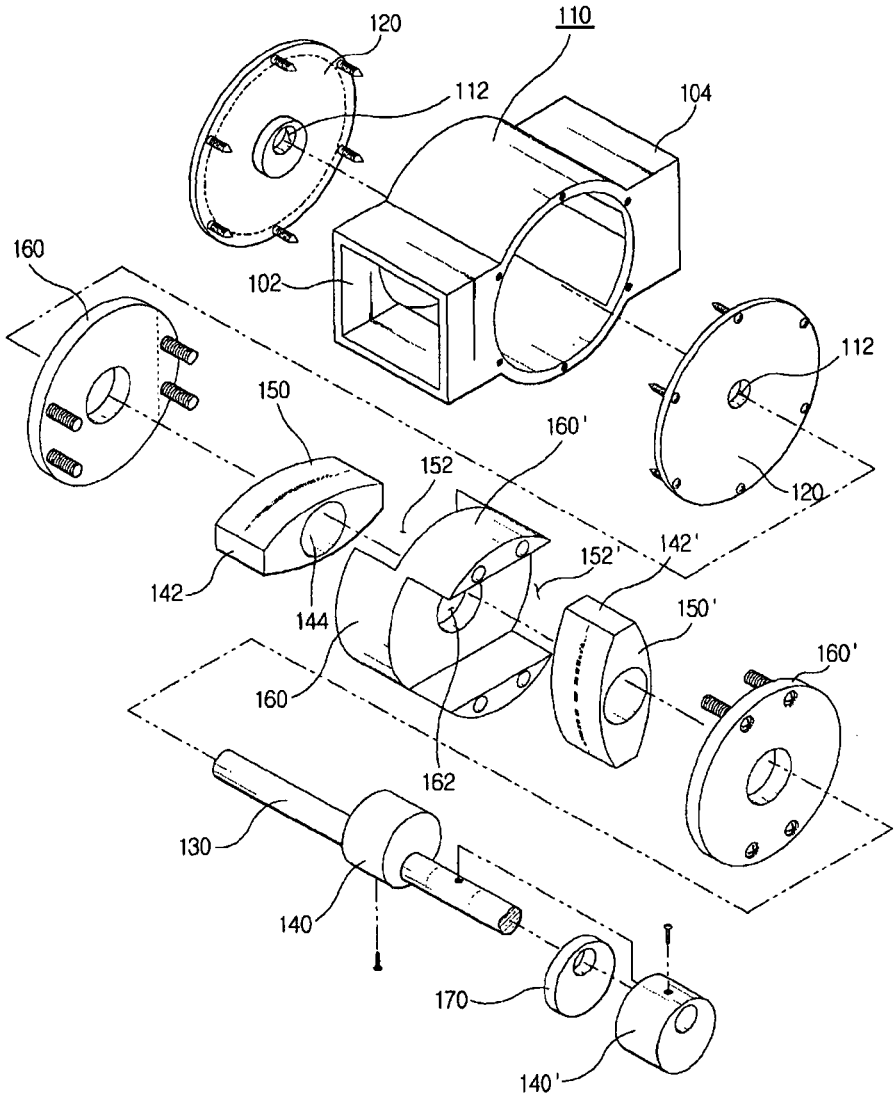
[Fig. 4]
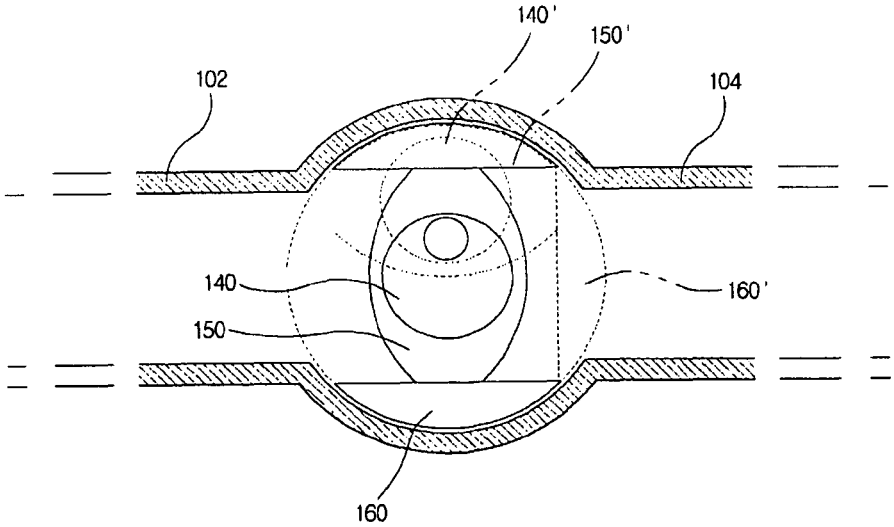

[Fig. 5]
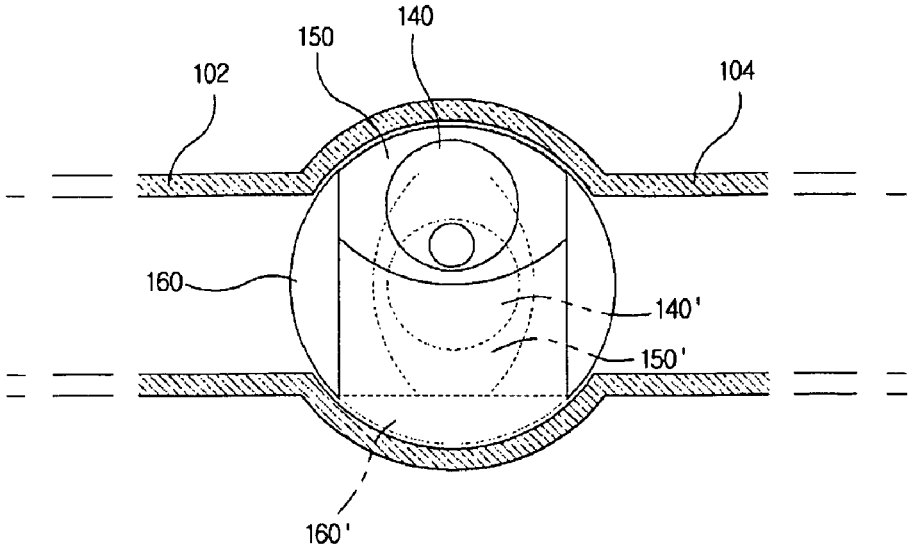
[Fig. 6]
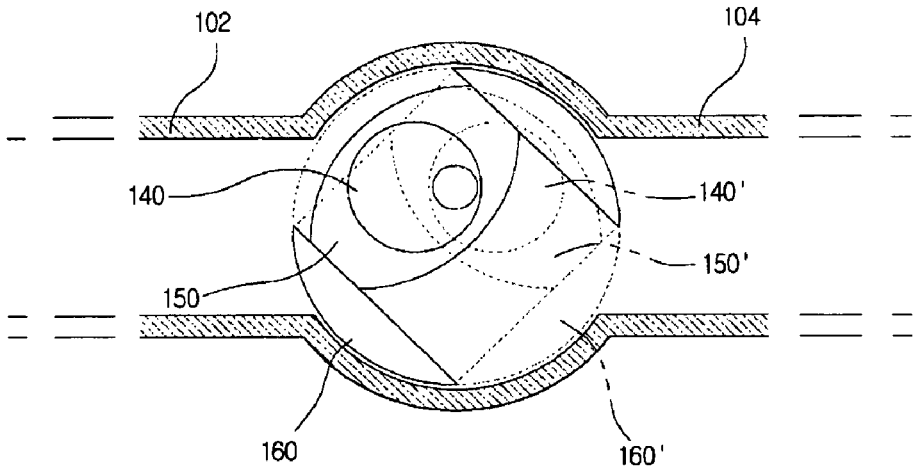
[Fig. 7]
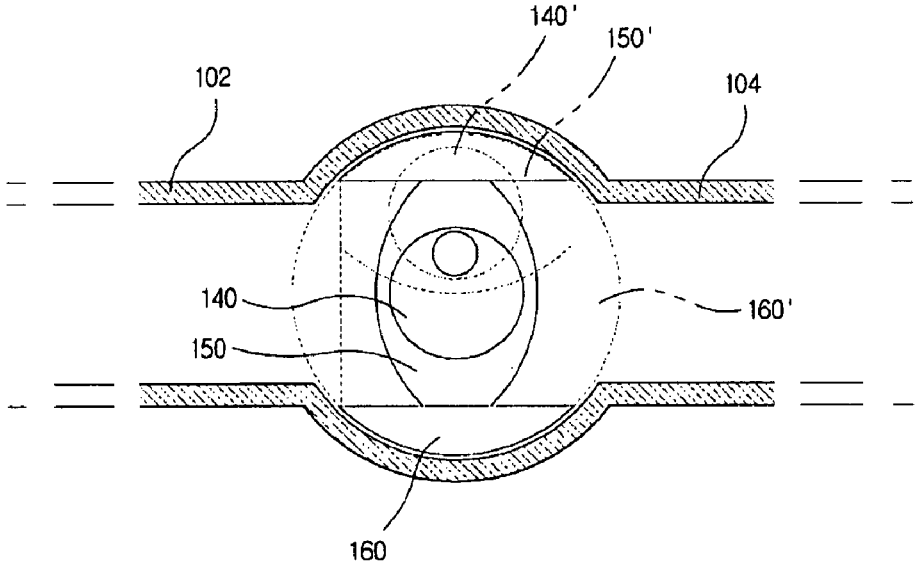

[Fig. 8]
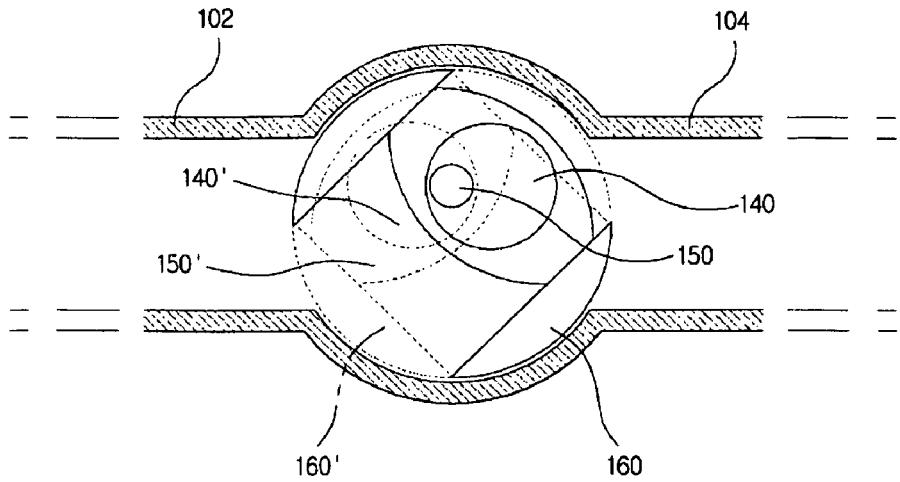
[Fig. 9]
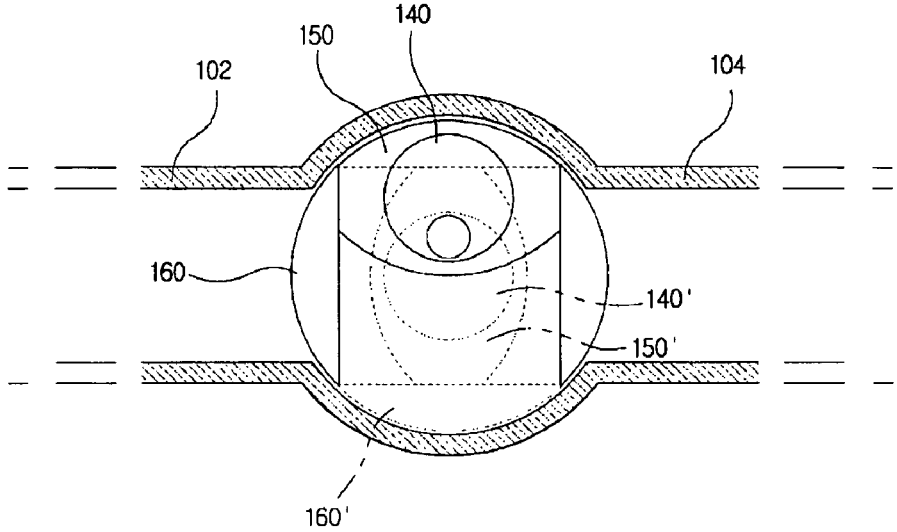
[Fig. 10]
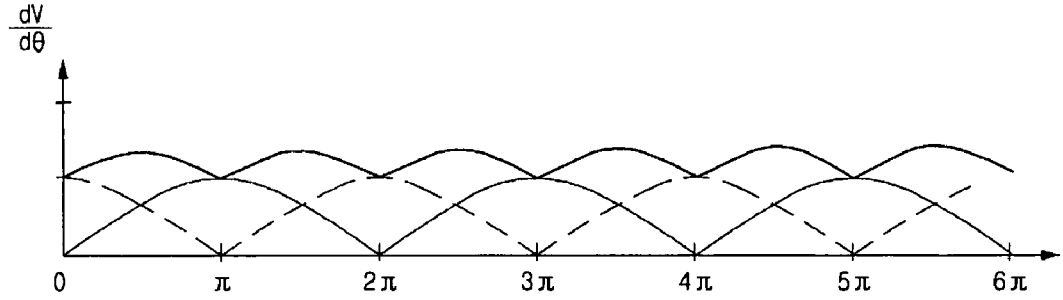

[Fig. 11]
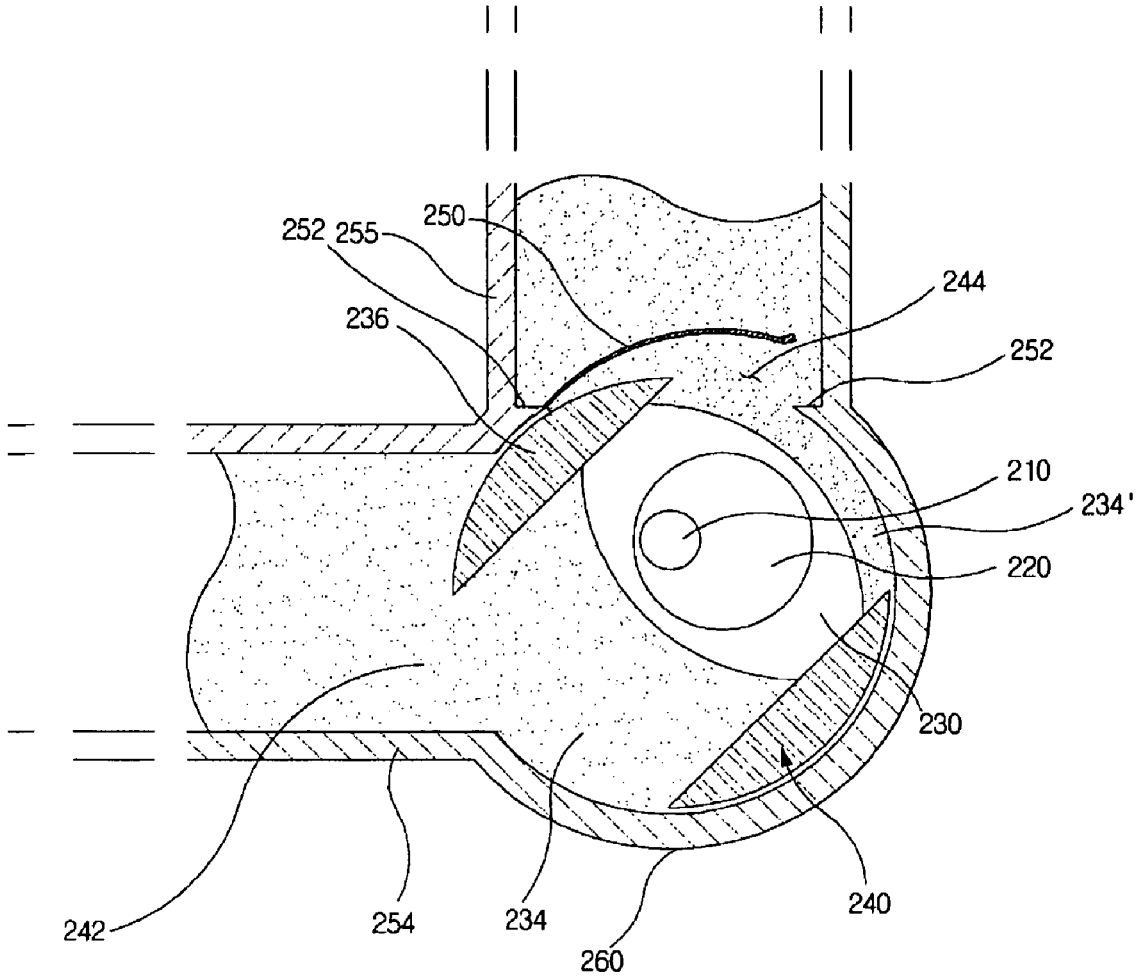

ROTARY PUMP

TECHNICAL FIELD

The present invention relates to a rotary pump in which one or more rotors each including a rotary cylinder and a rotary piston rotate upon receiving a torque inside a housing having a suction hole and a discharge hole to compress or pump fluid. More particularly, the present invention relates to a rotary pump in which two rotary pistons are arranged to revolve about a rotating shaft in a state wherein the center of mass of the two rotary pistons coincide with that of the rotating shaft, thereby achieving not only a reduction in the generation of vibrations or noise, but also a variation in the flow rate of fluid.

The present invention also relates to a rotary pump in which a cover is provided at a discharge hole to be freely opened or closed in accordance with a pressure, thereby preventing the generation of backflow and pulsations during the rotation of the rotary pump even when the pressure of the discharge hole differs from that of a suction hole.

BACKGROUND ART

Generally, a pump is a device to compress or pump fluid, for example, gas or liquid. Such a pump is operable to directly pump fluid, or to push fluid, having a pressure less than an atmospheric pressure, into a high-pressure tank. In accordance with the use purpose thereof, the pump may be called a compressor, a metering pump, a vacuum pump, etc. Herein, all kinds of pumps are simply called a pump.

A pump may be basically classified into a reciprocating pump and a rotary pump. The reciprocating pump is configured such that a piston reciprocates inside a cylinder to pump fluid. The rotary pump is configured such that rotors, gears, and screws rotate to serve as pistons.

Referring to FIG. 1, a conventional reciprocating pump 10 is a type of a capacity pump in which liquid is pumped in accordance with a variation in the volume of a closed space. The conventional reciprocating pump 10 comprises: a cylinder 16 having a suction valve 12 and a discharge valve 14; a reciprocating piston 18; and a connecting rod 20 to convert a rotating motion into a linear reciprocating motion of the piston 18. As the piston 18 linearly reciprocates into or out of the cylinder 16, fluid, for example, gas or liquid, is suctioned into or discharged from the cylinder 16. Specifically, when the piston 18 comes out of the cylinder 16, the internal pressure of the cylinder 16 is lowered, so that the discharge valve 14 is closed and the suction valve 12 is opened. Thereby, fluid received in a tank 22 is suctioned into the cylinder 16 via a suction pipe. In this case, there is no movement of fluid in a discharge pipe 24. Conversely, when the piston 18 enters the cylinder 16, the suction valve 12 is closed, and simultaneously, the fluid received in the cylinder 16 is discharged into the discharge pipe 24 while pushing the discharge valve 14. In this case, there is no movement of fluid in the suction pipe.

The above-described conventional reciprocating pump 10 of a single-acting pump type tends to cause an excessive variation in the flow rate of fluid and much more pulsations. For this reason, a double-acting or differential reciprocating pump has been used to solve the above problem. However, the double-acting or differential reciprocating pump for reducing the variation in the flow rate of fluid requires the use of a large number of cylinders, pistons, and valves, suffering from a complicated structure and failing to effectively reduce such a variation in the flow rate of fluid.

Further, the conventional reciprocating pump 10 has several other problems in that excessive noise and vibrations are inevitably caused by the linear reciprocating motion of the piston 18, the flow of fluid is often intermitted, and the inertia of the valves 12 and 14, the piston 18, and the connecting rod 20 prevents quick operation of the pump 10. To solve these problems, recently, a rotary pump, which is able to rotate quickly with reduced noise and vibrations, has been mainly used.

Referring to FIG. 2, a conventional rotary pump 50 comprises: a cylindrical housing 56 having a suction hole 52 and a discharge hole 54 formed at opposite locations on the circumference of the housing 56; a rotary cylinder 58 to revolve inside the housing 56; a rotary piston 60 to slide in the rotary cylinder 58; a revolving shaft 64 installed in the center of the rotary piston 60; and a rotating shaft 62 installed eccentric to the center of the rotary piston 60.

The rotary pump 50 eliminates the necessity of suction and discharge valves, a crank, and a connecting rod differently from the reciprocating pump 10. Simply, as the rotary cylinder 58 revolves inside the housing 56 along with several elements and the rotary piston 60 revolves about the rotating shaft 62 in the rotary cylinder 58, the volume of an interior space of the rotary cylinder 58 varies in accordance with a full circular motion, resulting in the pumping of fluid. Since the rotary pump 50 exhibits no intermittence in the flow of fluid differently from the above described single acting pump 10, the rotary pump 50 achieves a much more smooth flow of fluid and a high flow rate of fluid superior to even the combination of two single acting pumps. Accordingly, the rotary pump 50 is suitable to pump high-density fluid. Furthermore, the rotary pump 50 has an advantage in that, even if a high pressure is applied, the pressure acts as a torque of the rotating shaft 62 only, exerting no overload to a machine. The rotary pump 50 also completely discharges suctioned fluid, achieving high efficiency.

However, the conventional rotary pump 50 as described above has the following several problems.

The conventional rotary pump 50 suffers from vibrations during rotation since the rotating shaft 62 is connected to the revolving shaft 64 and the rotary piston 60, and the center of mass of both the revolving shaft 64 and the rotary piston 60 deviates from that of the rotating shaft 62. Of course, the vibrations may be completely eliminated by the use of a balance weight. However, this solution results in an increase in the overall volume and weight of the conventional rotary pump 50. Furthermore, although it is true that the conventional rotary pump 50 achieves a much more smooth flow of fluid as compared to the conventional reciprocating pump 10, the convention rotary pump 50 inevitably confronts an intermittence in the flow of fluid, too. Thus, the rotary pump 50 is not free from a rough flow of fluid and the generation of pulsations.

Further, although the conventional rotary pump 50 does not require the suction valve 12 and the discharge valve 14 of the reciprocating pump 10, the suction hole 52 and the discharge hole 54 at opposite sides of the housing 56 are closed or opened in accordance with the rotation of the rotary cylinder 58, causing various operational problems.

For example, in the case of the conventional rotary pump 50, the suction hole 52 and the discharge hole 54 are simultaneously opened or closed. In a state wherein the interior space of the rotary cylinder 58 is divided into two spaces by the use of the rotary piston 60, if the suction hole 52 is closed, the discharge hole 54 is simultaneously opened, whereas if the discharge hole 54 is closed, the suction hole 52 is simultaneously opened, in association with one of the two spaces. Thus, just when the suction hole 52 and the discharge hole 54 are closed or opened, the pressure of the space is equal to or similar to the pressure of the suction hole 52. Accordingly, when the conventional rotary pump 50 serve as a compression pump or vacuum pump, as soon as the discharge hole 54 is opened, gas at the outside of the suction hole 52 is suddenly suctioned into the lower pressure space of the rotary cylinder 58 through the suction hole 52, but is pushed outward through the suction hole 52 in accordance with the operation of the rotary piston 60. Such a quick backflow of gas results in an increase of pulsations and a rough flow of fluid.

Since there remains no effective space in the rotary cylinder 58 if the discharge hole 54 is closed, the fluid, suctioned through the suction hole 52, can be completely discharged through the discharge hole 54. However, rapidly discharging the fluid through a narrow opening of the discharge hole 54 that is being closed suddenly applies an excessive high-pressure to the rotary piston 60, hindering the rotation of the rotary piston 60. Of course, this problem may be solved by reducing the thickness of upper and lower arched surfaces of the rotary piston 60 to define spaces at upper and lower sides of the rotary piston 60. However, if the fluid is gas, the suctioned gas may partially remain in the spaces rather than being completely discharged, thereby causing backflow when the suction hole 52 is opened. For this reason, when the rotary pump is used as a compression pump, it achieves only a limited compression ratio lower than that of the spaces. On the other hand, when the rotary pump is used as a vacuum pump, the remaining gas results in deterioration in the degree of vacuum.

DISCLOSURE OF INVENTION

Technical Problem

The present invention has been made in order to solve the above problems, and it is a first object of the invention to provide a double-acting or differential rotary pump capable of achieving smooth flow of pumped fluid with a simplified structure.

It is a second object of the invention to provide a rotary pump capable of achieving a reduction in vibrations and noise during rotation without using a balance weight.

It is a third object of the invention to provide a rotary pump having no risk of backflow and pulsations even when the pressure of a suction hole differs from that of a discharge hole.

It is a fourth object of the invention to provide a rotary pump capable of completely discharging suctioned fluid while performing smooth rotating motion and of achieving an improvement in the compression ratio and the degree of vacuum.

Technical Solution

In accordance with a first aspect of the present invention, the above first and second objects can be accomplished by the provision of a rotary pump in which a suction hole and a discharge hole are repeatedly opened or closed in succession without using a valve and fluid is compressed or pumped in accordance with a variation in the volume of spaces as rotors rotate upon receiving an external torque, the rotary pump comprising: a housing defining a cylindrical interior space and provided with the fluid suction hole and the fluid discharge hole at opposite locations on the circumference of the housing; a rotating shaft rotatably inserted through holes formed at opposite ends of the housing and serving as a revolving axis of the housing; a pair of revolving shafts longitudinally spaced apart from each other on the rotating shaft at symmetric locations about the center of the rotating shaft, center axes of the revolving shafts being spaced apart from the center axis of the rotating shaft in opposite directions by the same distance; a pair of cuboidal rotary pistons fitted on the revolving shafts, respectively, each of the cuboidal rotary pistons having convex symmetrical arched upper and lower surfaces; and a pair of rotary cylinders installed to revolve inside the housing and having a pair of rotary cylinder chambers which are arranged to have a phase difference of 90° to each other for the sliding movement of the rotary pistons closely inserted in the respective rotary cylinder chambers; and a pair of disks each having a rotating shaft hole at a location eccentric to the center thereof and serving to separate the rotary cylinder chambers from each other.

When the revolving shafts and the rotary pistons revolve one-turn, the rotary cylinders rotate a half-turn.

In accordance with a second aspect of the present invention, the third and fourth objects of the present invention can be accomplished by the provision of a rotary pump in which a suction hole and a discharge hole are repeatedly opened or closed in succession in accordance with the rotation of rotors without using a valve and fluid is compressed or pumped in accordance with a variation in the volume of spaces as rotors rotate upon receiving an external torque, wherein the suction hole and the discharge hole are arranged adjacent to each other rather than being arranged at opposite locations. That is, as compared to the above-described configuration wherein both the suction hole and the discharge hole are formed at opposite sides of the rotary pump, only the discharge hole is displaced upward by an angle of 90°. In accordance with the second aspect of the present invention, also, an opening/closing cover is mounted at the discharge hole to be outwardly opened. The cover is configured to cover a protrusion defined between the discharge hole and an expanded discharge path having a diameter larger than a diameter of the discharge hole. When the pressure at the inside of the discharge hole is lower than the pressure at the outside of the discharge hole, the cover is moved inwardly to close the discharge hole. Conversely, when the pressure at the inside of the discharge hole is higher than the pressure at the outside of the discharge hole, the cover is pushed outwardly from the discharge hole by the high pressure, thereby allowing fluid to be discharged from the discharge hole.

Advantageous Effects

The rotary pump having the above-described configuration in accordance with the first aspect of the present invention has the effect of an achieving smooth flow of fluid with a simplified structure, and of preventing the generation of vibrations and noise without using a balance weight. As is well known, using the balance weight effectively prevents the vibrations and noise. Thus, the rotary pump of the present invention allows for the use of a light and small balance weight.

The rotary pump is applicable to a rotary engine.

The rotary pump having the above-described configuration in accordance with the second aspect of the present invention can be appropriately used as a compression pump or vacuum pump in which the pressures of the suction hole and the discharge hole differ from each other. Theoretically, the rotary pump has no limitation in the compression ratio or the degree of vacuum.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which:

FIG. 1 is a sectional view illustrating the configuration of a conventional reciprocating pump;

FIG. 2 is sectional view illustrating the configuration of a conventional rotary pump;

FIG. 3 is an exploded perspective view illustrating a rotary pump according to a first preferred embodiment of the present invention;

FIG. 4 is a sectional view illustrating the configuration of the rotary pump according to the first preferred embodiment of the present invention;

FIGS. 5 to 9 are sectional views illustrating the operation of the rotary pump according to the first preferred embodiment of the present invention;

FIG. 10 is a graph illustrating the variation of volume at a suction hole relative to a phase angle according to the first preferred embodiment of the present invention; and FIG. 11 is a sectional view illustrating the configuration of a rotary pump according to a second preferred embodiment of the present invention.

MODE FOR THE INVENTION

Now, preferred embodiments of a rotary pump in accordance with the present invention will be explained in detail with reference to the accompanying drawings. Herein, it is assumed that the angular speed of rotors is constant.

FIGS. 3 and 4 are an exploded perspective view and a sectional view, respectively, illustrating a rotary pump according to a first preferred embodiment of the present invention. FIGS. 5 to 9 are sectional views illustrating the operation of the rotary pump according to the first preferred embodiment of the present invention. FIG. 10 is a graph illustrating the variation of volume at a suction hole relative to a phase angle according to the first preferred embodiment of the present invention.

As shown in the above drawings, the rotary pump 100 in accordance with the first embodiment of the present invention comprises: a housing 110 defining a cylindrical interior space and provided with a fluid suction hole 102 and a fluid discharge hole 104 at opposite locations on the circumference of the housing 110; a pair of disks 120 coupled to the housing 110 to close opposite sides of the cylindrical interior space of the housing 110, each disk having a rotating shaft hole 112 perforated at a position eccentric to the center of a small disk centrally affixed thereto; a rotating shaft 130 inserted through the rotating shaft holes 112 of the disks 120; a pair of revolving shafts 140 and 140' longitudinally spaced apart from each other on the rotating shaft 130 at symmetrical locations about the center of the rotating shaft 130, center axes of the revolving shafts 140 and 140' being spaced apart from the center axis of the rotating shaft 130 in opposite directions by the same distance; a pair of cuboidal rotary pistons 150 and 150' fitted on the revolving shafts 140 and 140', respectively, each of the cuboidal rotary pistons 150 and 150' having convex symmetrical arched upper and lower surfaces; and a pair of rotary cylinders 160 and 160' installed to revolve in the housing 110 and having a pair of rotary cylinder chambers 152 and 152' which are arranged to have a phase difference of 90° to each other, each rotary cylinder chamber allowing for the sliding motion of an associated one of the rotary pistons and being opened at opposite sides thereof.

In operation of the rotary pump 100, if the revolving shafts 140 and 140' revolve one-turn, the rotary cylinders 160 and 160' and the rotary pistons 150 and 150' rotate a half-turn. That is, since the rotary pistons 150 and 150' are engaged with the rotary cylinders 160 and 160', when the rotary pistons 150 and 150' revolve one-turn about the rotating shaft 130, the rotary pistons 150 and 150' also rotate a half-turn following the rotary cylinders 160 and 160' that rotate a half-turn.

In the rotary pump 100 of the present invention, the pair of revolving shafts 140 and 140' are longitudinally spaced apart from each other on the rotating shaft 130 so that the center axes of the revolving shafts 140 and 140' are at the same distance from the center axis of the rotating shaft 130 in opposite directions. With this configuration, the center axes of the revolving shafts 140 and 140' form an angle of 180° about the center axis of the rotating shaft 130. Also, the rotary cylinder chambers 152 and 152' defined in the rotary cylinders 160 and 160' have a phase difference of 90° to each other and are parallel to each other in a longitudinal direction of the rotating shaft 130.

The rotary cylinder chambers 152 and 152' of the rotary cylinders 160 and 160' are connected to each other via a connection hole 162, but a plug 170 is fitted into the connection hole 162 to completely separate the rotary cylinder chambers 152 and 152' from each other. The plug 170 is drilled with additional rotating shaft hole 112.

A distance from the center axes of the rotary cylinders 160 and 160' to the center axis of the rotating shaft 130 is the same as a distance from the center axes of the revolving shafts 140 and 140' to the center axis of the rotating shaft 130. Accordingly, if the rotating shaft 130 rotates one-turn and correspondingly, the pair of revolving shafts 140 and 140' and the pair of rotary pistons 150 and 150' revolve one-turn about the rotating shaft 130, the rotary cylinders 160 and 160' revolve a half-turn, causing the rotary pistons 150 and 150' to rotate a half-turn.

Referring to FIG. 5, a half portion of the suction hole 102 and the discharge hole 104 are completely closed by the rotary cylinder 160 indicated by a solid line, and the remaining half portion of the suction hole 102 is completely connected to the rotary cylinder chamber 152' of the other rotary cylinder 160' indicated by a dotted line. Thereby, in association with the former half portion, the suction hole 102 begins to be closed to finish the suction of fluid, and simultaneously, the discharge hole 104 begins to be opened to discharge the suctioned fluid, resulting in zero variation in the volume of the rotary cylinder chamber 152. Conversely, in association with the remaining half portion, the rotary piston 150' begins to pass through the center of the rotary cylinder chamber 152', so that the fluid is suctioned at the left side of the rotary piston 150' while being discharged at the right side of the rotary piston 150', resulting in a maximized variation in the volume of the rotary cylinder chamber 152'.

FIGS. 5 to 9 illustrate a cycle of the rotary pump 100 when it rotates to pump fluid. FIG. 7 illustrates an inversed state of FIG. 5, and FIG. 9 illustrates a returned state identical to FIG. 5. Thus, FIGS. 5, 7, and 9 illustrate the same volumetric variation in the spaces of the rotary pump 100. Also, FIGS. 6 and 8 illustrate the same volumetric variation in the spaces of the rotary pump 100.

FIG. 10 illustrates the variation of volume in accordance with the rotation of the rotary pump 100. An abscissa of FIG. 10 indicates a phase of the rotating shaft 130 or the revolving shaft 140 of the rotary pump 100, and an ordinate of FIG. 10 indicates the variation of volume of spaces. Specifically, FIG. 6 illustrates the variation of volume at the suction hole 102 of the rotary pump 100. The variation of volume at the discharge hole 104 is symmetrical to curves of FIG. 6 based on a transverse axis. In FIG. 6, a slender solid line indicates the variation of volume at the half portion of the suction hole 102 associated with the rotary cylinder chamber 152 of the rotary pump 100, a dotted line indicates the variation of volume at the remaining half portion of the suction hole 102 associated with the rotary cylinder chamber 152', and a thick solid line indicates the sum of the two variations of volume. That is, the thick solid line indicates the variation of volume at the overall portion of the suction hole 102 of the rotary pump 100. Here, as will be easily understood, the thin and thick solid lines and the dotted line draw sine curves.

Based on the fact that liquid has substantially no variation in density, it can be understood that the flow rate of liquid is approximately the same as the variation of volume of the rotary cylinder chambers 152 and 152' when the rotary pump 100 pumps the liquid. Also, the flow of the pumped liquid is very smooth and shows lesser pulsations as shown in FIG. 6. Although the conventional reciprocating pump 10 may achieve a slightly smoother flow of fluid if it has four pairs of cylinders 16, the flow of fluid obtained by the conventional reciprocating pump 10 cannot be compared with the smooth flow of fluid of the rotary pump 100 because the piston 18 of the conventional reciprocating pump 10 reciprocates in accordance with the operation of the connecting rod 20, and thus, inevitably causes more a rough variation in the volume of the cylinder 16 than a sine curve.

The rotary pump 100 in accordance with the first embodiment of the present invention as stated above has a feature in that the flow of fluid is quantified. Thus, the rotary pump 10 is suitable to use in a varicose treatment apparatus, and other apparatuses for injecting a nutritive agent or antibiotic into a problematic digestive organ of a patient or for injecting an anodyne into a chronic pain patient.

FIG. 11 is a sectional view illustrating the configuration of a rotary pump according to a second preferred embodiment of the present invention.

As shown in FIG. 11, the rotary pump 200 in accordance with the second embodiment of the present invention comprises: a housing 260 having a cylindrical interior space for allowing revolution of rotary cylinders 240, the housing 260 having a fluid suction hole 242 located at the left side of the drawing, a fluid discharge hole 244 located at the upper side of the drawing, an expanded discharge pipe 255 connected to the discharge hole 244 and having a diameter larger than the diameter of the discharge hole 244, and a protrusion 252 defined between the discharge hole 244 and the expanded discharge pipe 255; a rotating shaft 210 to transmit an external torque to rotors; a revolving shaft 220 having a center axis eccentric to that of the rotating shaft 210; cuboidal rotary pistons 230 fitted on the revolving shaft 220 and each having convex arched upper and lower surfaces; the rotary cylinders 240 installed to revolve inside the housing 260 and internally defining rotary cylinder chambers 234 and 234', respectively, each of the rotary cylinder chambers 234 and 234' being opened at opposite sides thereof and being configured to allow for the sliding motion of the rotary pistons 230; and a cover 250 configured to cover the protrusion 252 at the outside of the discharge hole 244 to open or close the discharge hole 244 in accordance with a pressure.

In the present embodiment having the above-described configuration, it is important that the suction hole 242 and the discharge hole 244 are perforated at adjacent locations on the circumference of the housing 260, and the cover 250 is installed to be opened outwardly from the discharge hole 244.

The rotary pump 200 of the present embodiment is suitable to compress or pump gas. Now, the rotating operation of the rotary pump 200 will be explained with reference to FIG. 11. Here, the rotary pump 200 rotates counterclockwise. In operation, fluid is suctioned from a suction pipe 254 into the rotary cylinder chamber 234 through the suction hole 242, and then, is moved upward into the discharge pipe 255 through the discharge hole 244 while pushing the cover 250 upward. In particular, to open the cover 250, the pressure of the rotary sliding chamber 234' must be higher than the pressure of the discharge pipe 255. For this, the larger the difference between the pressures of the suction pipe 254 and the discharge pipe 255, the pressure of the rotary cylinder chamber 234' has to be lowered. This has the effect of reducing the opening time of the cover 250. As the rotors are further rotated, the volume of the rotary cylinder chamber 234 increases gradually, causing gas to be suctioned into the rotary cylinder chamber 234 from the suction pipe 254. Just when the suction hole 242 is closed by a cylinder wall 236 in accordance with the rotation of the rotary cylinder 240, the volume of the rotary cylinder chamber 234 is maximized, and the suction of gas from the lower side of the rotary piston 230 is finished. In this case, the volume of the rotary cylinder chamber 234' above the rotary piston 230 is minimized to be close to zero. Thereby, no gas is moved upward, and a force to push the cover 250 upward disappears. Thereby, the cover 250 closes the discharge hole 244 by the use of a downward pushing pressure applied from the discharge pipe 255 and the elasticity thereof. Subsequently, as the rotors are further rotated, the volume of the rotary cylinder chamber 234 decreases, causing the gas received in the rotary cylinder chamber 234 to be compressed. On the other hand, the volume of the rotary cylinder chamber 234 increases gradually, and simultaneously, the cylinder wall 236 opens the suction hole 242, allowing for the suction of gas. In this case, due to the fact that the suction hole 242 and the discharge hole 244 are adjacent to each other, there is a risk that the fluid, which receives a high pressure at the outside of the discharge hole 244, may be pushed into the suction hole 242. However, in the present embodiment, the cover 250 effectively prevents the backflow of fluid.

Although embodiments of the present invention have been shown and described, it would be appreciated by those skilled in the art that changes may be made in this embodiment without departing from the principles and spirit of the invention, the scope of which is defined in the claims and their equivalents. For example, the rotary pump in accordance with the embodiment of the present invention may be applied to a rotary engine to rotate a rotor by the use of an expansion force of gas, an expansion force of hot air, or an expansion force of compressed air.

INDUSTRIAL APPLICABILITY

As apparent from the above description, the present invention provides a rotary pump having the following effects.

Firstly, the rotary pump of the present invention can much more smoothly pump an increased amount of fluid with a simplified configuration superior to a reciprocating pump having four pairs of cylinders.

Secondly, the rotary pump can achieve a reduction in vibrations and noise, and can prevent not only backflow and pulsations, which may be periodically caused when gas is compressed or pumped, but also a sudden excessive pressure hindering the rotation of the rotary pump.

Thirdly, the rotary pump can be mass produced with a high productivity within a shortened time. This has the effect of lowering a product price and achieving stability and reliability of products.

The invention claimed is:

1. A rotary pump in which a fluid suction hole and a fluid discharge hole are opened or closed in accordance with the rotation of a rotor and fluid is compressed or pumped in accordance with the variation of volume of spaces, rotary pump comprising:

a housing having a cylindrical interior space for allowing for the revolution of a rotary cylinder and provided with the fluid suction hole and the fluid discharge hole at perpendicularly adjacent locations on the circumference of the housing:

a rotating shaft serving as a revolving shaft of a cuboidal rotary piston;

a revolving shaft fitted on the rotating shaft and having a center axis eccentric to a center axis of the rotating shaft;

the cuboidal rotary piston fitted on the revolving shaft to revolve about the revolving shaft and having convex arched upper and lower surfaces;

the rotary cylinder installed to revolve in the cylindrical interior space of the housing while being closely received in the cylindrical interior space and internally defining rotary cylinder chambers for the sliding movement of the cuboidal rotary piston an expanded discharge pipe connected to the discharge hole and having a diameter larger than a diameter of the discharge hole to define an inwardly-extending protrusion between the discharge hole and the expanded discharge pipe; and a cover provided at the discharge hole to be opened outwardly in accordance with a pressure of fluid, thereby serving to prevent the fluid, which receives a high pressure at the outside of the discharge hole, from being pushed into an associated one of the rotary cylinder chambers.

* * * * *